US007416395B2

(12) United States Patent
Sato

(10) Patent No.: US 7,416,395 B2
(45) Date of Patent: Aug. 26, 2008

(54) SLEEVE FOR COUPLING A REFRIGERANT PIPE TO A COMPRESSOR CONTAINER

(75) Inventor: Kazuya Sato, Gunma-ken (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 130 days.

(21) Appl. No.: 11/238,107

(22) Filed: Sep. 28, 2005

(65) Prior Publication Data

US 2006/0073061 A1 Apr. 6, 2006

(30) Foreign Application Priority Data

Sep. 29, 2004 (JP) ..... 2004-284265

(51) Int. Cl.
*F03C 2/00* (2006.01)
*F04C 18/00* (2006.01)

(52) U.S. Cl. ..... 418/60; 418/63; 418/149; 285/288.1; 285/332; 285/397; 285/398

(58) Field of Classification Search ..... 418/60, 418/62, 63, 149; 285/332, 369, 370, 397, 285/398

See application file for complete search history.

(56) References Cited

U.S. PATENT DOCUMENTS 3,871,800 A * 3/1975 Slayton ..... 418/248
4,648,811 A * 3/1987 Tahata et al. ..... 417/902
4,815,947 A * 3/1989 Okoma et al. ..... 417/902
5,573,285 A * 11/1996 Ridenour ..... 285/353
6,158,995 A * 12/2000 Muramatsu et al. ..... 418/181

FOREIGN PATENT DOCUMENTS

| | | | |
|---|---|---|---|
| JP | 60069392 A | | 4/1985 |
| JP | 63036075 A | * | 2/1988 |
| JP | 11182434 A | * | 7/1999 |
| JP | 2004150370 A | | 5/2004 |
| JP | 2005220793 A | * | 8/2005 |
| KR | 20030050498 A | | 6/2003 |

* cited by examiner

*Primary Examiner*—Theresa Trieu
(74) *Attorney, Agent, or Firm*—Weingarten, Schurgin, Gagnebin & Lebovici LLP

(57) ABSTRACT

A sleeve connecting a refrigerant pipe to a sealed compressor container has a reduced outer dimension and an inner step that accommodates the refrigerant pipe. An end of the refrigerant pipe abuts the inner step to accurately locate the refrigerant pipe to permit the refrigerant pipe to be secured in an desired relationship with the sleeve. The sleeve is attached to the container with increased accuracy and less chance of damage to the container through deformation during the attachment process. The sleeve and container may be composed of iron, while the refrigerant pipe may be composed of copper, so that the more rigid sleeve can accurately couple the less rigid refrigerant pipe to the container.

3 Claims, 3 Drawing Sheets

SLEEVE FOR COUPLING A REFRIGERANT PIPE TO A COMPRESSOR CONTAINER

This application claims priority to a Japanese application Ser. No. 2004-284265 filed Sep. 29, 2004.

BACKGROUND OF THE INVENTION

1. Field of the Invention

The present invention relates to a compressor for compressing a refrigerant suitable for use in, for example, an air conditioning system, a water heater, a car air conditioner, a showcase, a freezer and refrigerator, or a refrigeration unit such as an automatic dispenser.

2. Description of the Related Art

In such a conventional compressor, for example, in a multistage compression type rotary compressor of an inside intermediate-pressure type, refrigerant gas is drawn into a low pressure chamber side of a cylinder from a refrigerant introduction pipe via a suction port of a first rotary compression element. The refrigerant gas is then compressed by operations of a roller and a vane to become intermediate pressure, and is discharged from a high pressure chamber side of the cylinder through a discharge port and a noise eliminating chamber into a sealed container.

The intermediate-pressure refrigerant gas in the sealed container is drawn into the lower pressure chamber side of the cylinder from a suction port of a second rotary compression element, and then is subjected to a second stage compression by the operations of the roller and the vane to become high-temperature and high-pressure refrigerant gas. The refrigerant gas flows from the high pressure chamber side of the cylinder through the discharge port and the noise eliminating chamber, and is discharged from a refrigerant discharge pipe to the outside of the compressor to be supplied to a refrigerating cycle, such as an air conditioning system, where the refrigerant gas radiates heat and is condensed to enter an evaporator. In the evaporator, heat of the refrigerant gas is absorbed and the refrigerant gas is evaporated. Thereafter the refrigerant gas is drawn again into the first rotary compression element through the refrigerant introduction pipe. This cycle is repeated.

In a sealed-type electric compressor with such an arrangement, a refrigerant introduction pipe or a refrigerant discharge pipe is connected to a cylindrical sleeve which is welded and fixed to a curved surface of a sealed container having a cylindrical shape. The typical conventional structure of the sleeve is shown in FIGS. 6 and 7.

A sleeve 141X as exemplified in FIG. 6 is made of iron material having large rigidity. A tapered tip end side of the sleeve 141X is attached to an outer wall surface of the sealed container made of iron by projection welding with its inner surface brazed and fixed to a pipe member 145X made of copper material having good ductility, but less rigidity than the iron, for connection with a refrigerant pipe.

A sealed pipe having its tip end leading to a cylinder of compression means existing in the sealed container is inserted into the inside of the pipe member 145X made of copper. Into the sealed pipe, a refrigerant introduction pipe or a refrigerant discharge pipe is further fitted and connected.

The sleeve 141X as exemplified in FIG. 7 has a tapered side part with a large thickness, which is attached to the sealed container by the projection welding.

In a compressor including a sleeve having a shape such as that shown in FIG. 6, since a sleeve body incorporates therein the pipe, the sleeve body itself becomes larger than the pipe. This disadvantageously results in an increased diameter of a part which is projection welded, which leads to reduction in the strength of resistance to pressure of the welded part. The method for fixing the pipe involves simply inserting the copper pipe into the sleeve body and brazing it thereto, thus making it difficult to attach the pipe to the sleeve body at the right angle with respect to the body. This causes a problem that attachment of the refrigerant introduction pipe and the like cannot be carried out constantly in the same way.

In a compressor including a sleeve having a shape such as that shown in FIG. 7, since a part of a sleeve that is subjected to the projection welding has a large thickness, when the sleeve is attached to a container body by welding, the container body is largely pushed, thereby disadvantageously resulting in large deformation of the container body.

SUMMARY OF THE INVENTION

To solve the above problems, the invention has an object to provide a compressor which achieves downsizing of a sleeve to be attached to a sealed container, while improving the strength of resistance to pressure of a welded part, which can simply connect a copper pipe to a sleeve body made of iron at the right angle, and which prevents the sealed container from being largely pushed when the sleeve is attached to the sealed container by projection welding.

According to a first aspect of the invention, there is provided a compressor comprising sleeves respectively attached to an inlet and an outlet for a refrigerant provided in and opened to a sealed container, by projection welding, wherein a refrigerant is introduced from an outside of the container via a refrigerant introduction pipe connected to the container via the sleeve for the refrigerant inlet, and then the refrigerant introduced is compressed by compression means incorporated in the sealed container to be discharged to the outside of the container via a refrigerant discharge pipe connected to the container via the sleeve for the refrigerant outlet. The sleeve includes a through hole formed of a small-inner-diameter portion and a large-inner-diameter portion which are provided consecutively via a step portion. The sleeve is formed such that an outer peripheral part of the sleeve on an open end side of the small-inner-diameter portion is tapered. The sleeve is attached to the sealed container by the projection welding with the tapered part facing a side of the sealed container.

According to a second aspect of the invention, there is provided a compressor comprising sleeves respectively attached to an inlet and an outlet for a refrigerant provided in and opened to a sealed container, by projection welding, wherein a refrigerant is introduced from an outside of the container via a refrigerant introduction pipe connected to the container via the sleeve for the refrigerant inlet, and then the refrigerant introduced is compressed by compression means incorporated in the sealed container to be discharged to the outside of the container via a refrigerant discharge pipe connected to the container via the sleeve for the refrigerant outlet. The sleeve includes a through hole penetrating a small-outer-diameter portion and a large-outer-diameter portion which are provided consecutively via a step portion, an inner diameter of the through hole on an open end side of the small-outer-diameter portion being gradually increased towards the open end side of the small-outer-diameter portion. The sleeve is formed such that an outer peripheral part of the sleeve on the open end side of the small-outer-diameter portion is tapered. The sleeve is attached to the sealed container by the projection welding with the tapered part facing a side of the sealed container.

According to a third aspect of the invention, there is provided a compressor comprising sleeves respectively attached to an inlet and an outlet for a refrigerant provided in and opened to a sealed container, by projection welding, wherein a refrigerant is introduced from an outside of the container via a refrigerant introduction pipe connected to the container via the sleeve for the refrigerant inlet, and then the refrigerant introduced is compressed by compression means incorporated in the sealed container to be discharged to the outside of the container via a refrigerant discharge pipe connected to the container via the sleeve for the refrigerant outlet. The sleeve includes a through hole penetrating a small-outer-diameter portion and a large-outer-diameter portion which are provided consecutively via a step portion, the through hole being formed of a small-inner-diameter portion provided mainly in the small-outer-diameter portion and a large-inner-diameter portion provided in the large-outer-diameter portion, the small-inner-diameter portion and the large-inner-diameter portion being provided consecutively via another step portion, an inner diameter of the through hole on an open end side of the small-outer-diameter portion being gradually increased towards the open end side of the small-outer-diameter portion. The sleeve is formed such that an outer peripheral part of the sleeve on the open end side of the small-outer-diameter portion is tapered. The sleeve is attached to the sealed container by the projection welding with the tapered part facing a side of the sealed container.

In the compressor according to any one of the above-mentioned aspects, the sleeve made of iron-based material is provided with a pipe member made of copper-based material which member is inserted into the large-inner-diameter side of the through hole with an end thereof abutted against the step portion, and then is brazed and fixed to the sleeve. The sleeve is attached to the sealed container made of iron-based material by the projection welding.

In the first aspect, one end surface of the copper pipe or the like for connection with the refrigerant pipe is abutted against and fixed to the step portion provided in the sleeve, thereby facilitating positioning of the copper pipe in the sleeve at the right angle. Since the copper pipe does not penetrate to be set in the sleeve, the sleeve is downsized and the diameter of the part subjected to the projection welding becomes smaller, thereby improving the strength of resistance to pressure of the welded part.

In the second aspect, since the sleeve includes the tapered part with a small difference between the outer and inner diameters and is attached to the sealed container by the projection welding, the sealed container is not pushed and moved largely when pressure is applied in the projection welding. This leads to small deformation in the sealed container. Any fluctuations in stroke of pressure applied do not affect largely the size of the contact area with the sealed container. This results in small fluctuations in current density, and thus provides the stable welding.

In the third aspect, both effects of the first and second aspects can be produced. In the fourth aspect, the compressor of the invention can have enough strength of resistance to pressure to serve as a $CO_2$ compressor whose inner pressure may be high due to the use of $CO_2$ whose condensed temperature is high as the refrigerant.

DESCRIPTION OF THE PREFERRED EMBODIMENTS

In one preferred embodiment of the invention, there is provided a compressor which comprises sleeves respectively attached to an inlet and an outlet for a refrigerant which are provided in and opened to a sealed container, by projection welding, wherein a refrigerant is introduced from an outside of the container via a refrigerant introduction pipe connected to the container via the sleeve for the refrigerant inlet, and then the refrigerant introduced is compressed by compression means incorporated in the sealed container to be discharged to the outside of the container via a refrigerant discharge pipe connected to the container via the sleeve for the refrigerant outlet. The sleeve includes a through hole penetrating a small-outer-diameter portion and a large-outer-diameter portion which are provided consecutively via a step portion. The through hole is formed of a small-inner-diameter portion provided mainly in the small-outer-diameter portion and a large-inner-diameter portion provided in the large-outer-diameter portion, the small-inner-diameter portion and the large-inner-diameter portion being provided consecutively via another step portion. An inner diameter of the through hole on an open end side of the small-outer-diameter portion is gradually increased towards the open end side of the small-outer-diameter portion. The sleeve is formed such that an outer peripheral part of the sleeve on the open end side of the small-outer-diameter portion is tapered. The sleeve, which is made of iron-based material, is fitted into the large-inner-diameter side of the through hole with one end thereof abutted against the step portion, and is brazed and fixed to a pipe member made of copper-based material. The sleeve is attached to the sealed container by the projection welding with a tapered part facing a side of the sealed container made of iron-based material.

First Preferred Embodiment

A first preferred embodiment of the invention will be described below in detail with reference to FIGS. 1 to 4.

Figure 1:
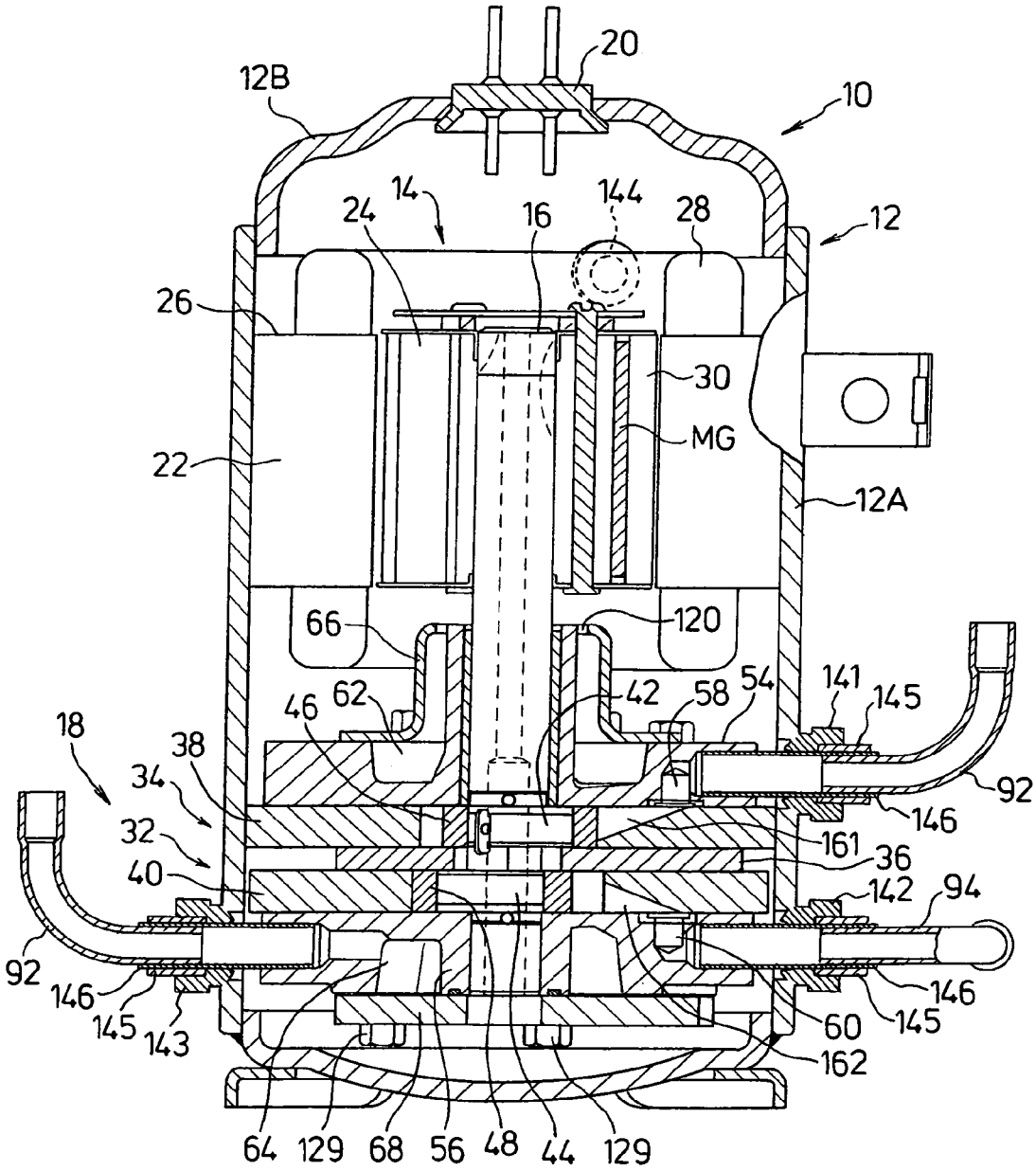
FIG. 1 is a schematic longitudinal sectional view showing one preferred embodiment of the invention (an inside intermediate-pressure type two-stage rotary compressor)
Figure 6:
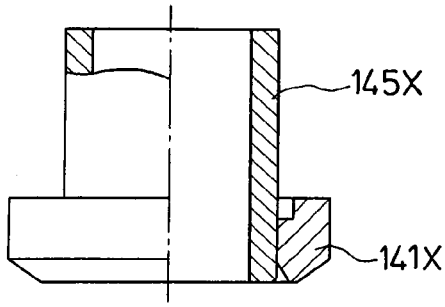
Fig. 6 PRIOR ART
FIG. 6 is a longitudinal side view of a sleeve constituting a part of a conventional compressor.
Figure 7:
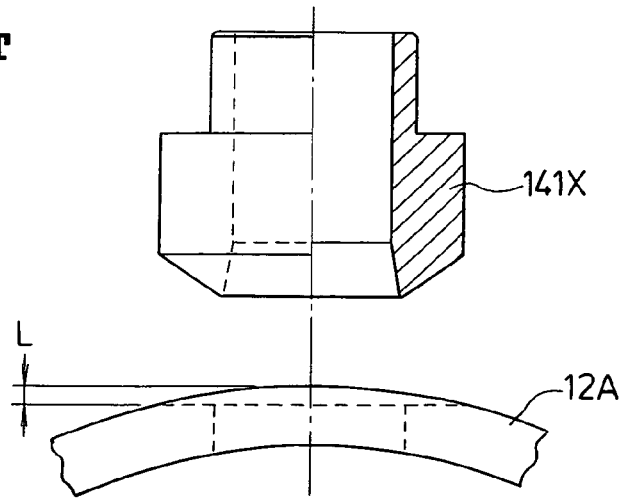
Fig. 7 PRIOR ART
FIG. 7 is a diagram explaining another sleeve constituting a part of a conventional compressor, and a container body to which the sleeve is attached.

FIG. 1 is a longitudinal sectional view showing a multistage (two-stage) compression type rotary compressor of an inside high-pressure type 10 which includes first and second rotary compression elements 32 and 34 according to the first embodiment. For simple understanding, in FIGS. 1 to 4, elements that have the same functions as those explained in FIGS. 6 and 7 are given the same reference numerals.

Referring to FIG. 1, the multistage (two-stage) compression type rotary compressor of the inside high-pressure type 10 is designed to compress a carbon dioxide ($CO_2$) which is to be used as a refrigerant for an air conditioning system. The rotary compressor 10 comprises a cylindrical sealed container 12 made of a steel plate, a drive element 14 disposed at and accommodated in an upper side of an inner space of the sealed container 12, and a rotary compression mechanism 18 composed of the first rotary compression element 32 (first stage) and the second rotary compression element 34 (second stage) which are respectively disposed under the drive element 14 and driven by a rotary shaft 16 of the drive element 14.

The sealed container 12 has its bottom serving as an oil reservoir, and includes a container body 12A for accommodating therein the drive element 14 and the rotary compression mechanism 18, and an end cap (cover) 12B with a substantially bowl shape for closing an opening positioned at an upper part of the container body 12A. A terminal 20 (wiring of which is omitted in description) for supplying power to the drive element 14 is attached to the center of the end cap 12B.

The drive element 14 includes a stator 22 which is annularly attached to the inner peripheral surface of the sealed container 12 in the upper space thereof, and a rotor 24 inserted into and provided inside the stator 22 with a slight clearance. The rotary shaft 16 extending vertically through the center of the stator 22 is fixed to the rotor 24.

The stator 22 includes a laminated body 26 formed by laminating doughnut-shaped electromagnetic steel plates and a stator coil 28 which is wound around the teeth of the laminated body 26 by direct winding (concentrating winding). The rotor 24 is formed by inserting a permanent magnet MG into a laminated body 30 made of electromagnetic steel plates like the stator 22.

An intermediate partition plate 36 is held between the first rotary compression element 32 and the second rotary compression element 34. That is, both the first rotary compression element 32 and the second rotary compression element 34 comprise the intermediate partition plate 36, upper and lower cylinders 38, 40 disposed over and under the intermediate partition plate 36, upper and lower eccentric portions 42, 44 provided on the rotary shaft 16, upper and lower rollers 46, 48 which are eccentrically rotated inside the upper and lower cylinders 38, 40 while fitted into the upper and lower eccentric portions 42, 44 with a 180-degree phase difference therebetween, upper and lower vanes (not shown) abutting against the upper and lower rollers 46, 48 and partitioning each of the upper and lower cylinders 38, 40 into a lower pressure chamber side and a high pressure chamber side, and an upper support member 54 and a lower support member 56 serving both as supporting means by closing an upper opening face of the upper cylinder 38 and the lower opening face of the lower cylinder 40, and as bearing means of the rotary shaft 16.

There are provided in the upper support member 54 and lower support member 56, suction passages 58, 60 which communicate with the inside of the upper and lower cylinders 38 and 40 through suction ports 161, 162, and noise eliminating chambers 62, 64 which are recessed. Both the noise eliminating chambers 62, 64 have openings thereof opposite to the upper and lower cylinders 38, 40 closed with respective covers. That is, the noise eliminating chamber 62 is blocked by an upper cover 66, and the noise eliminating chamber 64 is blocked by a lower cover 68.

The upper cover 66 has its periphery fixed to the upper support member 54 from above by four main bolts 78. The tip end of each of the main bolts 78 is screw-engaged with the lower support member 56. Above the upper cover 66 is positioned the drive element 14.

The noise eliminating chamber 62 of the upper support member 54 and the interior of the sealed container 12 communicate with each other through a discharge hole 120 which is open towards the drive element 14 in the sealed container 12, penetrating the upper cover 66. Thus, refrigerant gas compressed by the second rotary compression element 34 is discharged into the sealed container 12 through the discharge hole 120.

The lower cover 68 is made of a doughnut-shaped circular steel plate, and it is fixed to the lower support member 56 from below by screwing four main bolts 129 at four spots on the periphery thereof to block an opening disposed on the lower surface of the noise eliminating chamber 64. The tip end of each main bolt 129 is screw-engaged with the upper support member 54.

Sleeves 141, 142, 143, and 144 are respectively fixed to the side surface of the container body 12A of the sealed container 12 by welding at open positions corresponding to the suction passages 58, 60 of the upper and lower support members 54, 56, the noise eliminating chamber 64, and the portion above the rotor 24 (portion directly above the drive element 14).

The sleeve 141 is vertically adjacent to the sleeve 142. The sleeve 142 is positioned substantially opposite to the sleeve 143 with respect to the rotary shaft 16. The sleeve 141 is displaced from the sleeve 144 by about 90 degrees with respect to the rotary shaft 16.

One end of a refrigerant introduction pipe 92 is inserted into and connected to the sleeve 141 to communicate with the suction passage 58 of the upper support member 54. The other end of the refrigerant introduction pipe 92 passes through the upper part of the sealed container 12, and is inserted into and connected to the sleeve 143 to communicate with the noise eliminating chamber 64 of the lower support member 56. A refrigerant introduction pipe 94 is inserted into and connected to the sleeve 142 to communicate with the suction passage 60 of the lower support member 56. A refrigerant discharge pipe not shown is inserted into and connected to the sleeve 144.

A method for attachment of the sleeves 141 to 144 will be explained below with reference to FIGS. 2 and 3. On the outer side, namely a curved surface 100 of the sealed container 12 (container body 12A), circular through holes 102 are formed at positions (at four points in this case) to which the sleeves 141 to 144 are to be attached. A circular recess 104 is formed on the periphery of each of the through holes 102 on the outer surface side of the container body 12A. Further, on the periphery of the through hole 102 located at the bottom of the recess 104, is formed a flat surface 106 parallel to a tangent line with respect to an inner diameter of the container body 12A of the sealed container 12.

On the other hand, the sleeve 141 includes a small-outer-diameter portion 152 and a large-outer-diameter portion 153 which are provided consecutively via a surrounding step portion 151. (Note that each of the sleeves 142 to 144 has the same structure as that of the sleeve 141, and thus explanation thereof will be omitted.) On an open end side of the small-outer-diameter portion 152 opposite to the large-outer-diameter portion 153, a tapered diameter-reduction portion 154 is provided which has its outer diameter gradually reduced towards the end.

The sleeve 141 includes a through hole 155 penetrating the small-outer-diameter portion 152 and the large-outer-diameter portion 153. The through hole 155 is formed of a small-inner-diameter portion 155A disposed mainly in the small-outer-diameter portion 152, and a large-inner-diameter portion 155C disposed in the large-outer-diameter portion 153, the large-inner-diameter portion 155C and the small-inner-diameter portion 155A being provided consecutively via a surrounding step portion 155B. On an open end side of the small-inner-diameter portion 155A, a tapered diameter-enlargement portion 155*a* is provided which has its inner diameter gradually increased towards the end.

A pipe member 145 having good ductility, but less rigidity than the sealed container 12 is fitted into the large-inner-diameter portion 155C of the through hole 155 with one end thereof abutted against the step portion 155B. A surrounding recess 156 formed between the sleeve 141 and the pipe member 145 is filled with brazing filler metals such as a silver brazing filler metal, and then the pipe member 145 is fixed to the sleeve 141, for example, by brazing in a furnace.

At this time, the pipe member 145 is inserted from the open end of the large-inner-diameter portion 155C into the through hole 155, and an end surface of the pipe member 145 is abutted against the surrounding step portion 155B provided in the sleeve 141, thereby facilitating positioning of the pipe member 145 in the sleeve 141 at the right angle. Note that the inner diameter of the small-inner-diameter portion 155A of the through hole 155 is the same as that of the pipe member 145. The outer circumferential surface of the pipe member 145 may be subjected to knurling treatment, thereby enhancing inflow properties of the brazing filler metal.

When the sleeve 141 with the pipe member 145 is attached to the container body 12A, first the tapered diameter-reduction portion 154 of the sleeve 141 is fitted into the through hole 102 of the container body 12A from the outside. At this time, the flat surface 106 is parallel to the tangential line of the outer side or curved surface 100 of the container body 12A, and an axis 140 of the sleeve 141 is aligned with the through hole 102 so as to be perpendicular to the tangential line of the outer side or curved surface 100. This causes the tapered diameter-reduction portion 154 of the sleeve 141 to abut against all corners between the flat surface 106 positioned at the bottom of the recess 104 and the through hole 102 in a circumferential direction.

Under this condition, projection welding is performed by applying pressure of about 0.4 MPa on the container body 12A side via a flat end surface of the large-outer-diameter portion 153 using a jig for pressure application not shown, and by applying current of about 26 kA to a contact part between the diameter-reduction portion 154 of the sleeve 141 and the container body 12A. This causes the abutment or contact part between the sleeve 141 and the container body 12A to melt, so that the sleeve 141 is welded to the container body 12A (see FIG. 4).

It should be noted that technology for welding the sleeve 141 to the container body 12A by the projection welding is well known, and hence a detailed explanation thereof will be omitted below. Since, in the embodiment of the invention described, the pipe member 145 does not penetrate to be set in the sleeve 141 of the rotary compressor 10, the inner diameter of the tapered small-outer-diameter portion 152 side of the sleeve 141 can be thinner than that of the pipe member 145, thereby downsizing the sleeve 141, while improving the strength of resistance to pressure of the part subjected to the projection welding.

The tapered diameter-reduction portion 154 of the sleeve 141 is formed so as to have a diameter smaller than that of the large-outer-diameter portion 153 against which the jig for pressure application is abutted in the projection welding, and to have a smaller difference between the outer and inner diameters. A distance over which the container body 12A is pushed and moved becomes so small that an amount of deformation of the container body 12A can be decreased.

Further, since the difference between the outer and inner diameters of the diameter-reduction portion 154 is smaller than that of the conventional sleeve, any fluctuations in stroke of pressure applied in the projection welding does not affect largely the size of the contact area with the sealed container 12A. This results in small fluctuations in current density, and thus provides the stable welding.

Since the diameter-enlargement portion 155*a* whose inner diameter is gradually increased towards the end of the sleeve 141 is provided in the through hole 155 of the sleeve 141, even if the inner diameter of the small-inner-diameter portion 155A side is decreased by heat and pressure applied in the projection welding, it does not become smaller than the inner diameters of other parts of the through hole 155. Accordingly, the sealed pipe member 146 having good ductility is not inhibited from being fitted into the through hole 155 of the sleeve 141 for connection with the refrigerant introduction pipe 92 or the like.

The refrigerant introduction pipe 92 has its end inserted into and connected to the sleeve 141 attached to the sealed container 12 as described above to communicate with the suction passage 58 of the upper support member 54. The other end of the refrigerant introduction pipe 92 passes through the upper part of the sealed container 12, and is inserted into and connected to the sleeve 143 to communicate with the noise eliminating chamber 64 of the lower support member 56. The refrigerant introduction pipe 94 is inserted into and connected to the sleeve 142 to communicate with the suction passage 60 of the lower support member 56. The refrigerant discharge pipe not shown is inserted into and connected to the sleeve 144.

In the rotary compressor 10, carbon dioxide ($CO_2$) which is natural refrigerant is used as a refrigerant considering earth consciousness, inflammability, toxicity or the like, and an existing oil such as mineral oil, polyalkyleneglycol (PAG), alkylbenzene oil, ether oil, ester oil, or the like is used as the oil of the lubricant.

In the rotary compressor 10 of the embodiments with the above arrangement, when a stator coil 28 of the drive element 14 is energized via the terminal 20 and the wiring not shown, the drive element 14 is operated to rotate the rotor 24. Once the rotor 24 is rotated, the upper and lower rollers 46, 48 engaged with the upper and lower eccentric portions 42, 44 which are integrally provided with the rotary shaft 16 are caused to rotate eccentrically in the upper and lower cylinders 38, 40, as described above.

As a result, a lower pressure (about 4 MPaG) refrigerant gas supplied via a refrigerant introduction pipe 94 is drawn into the low pressure chamber side of the lower cylinder 40 from a suction port 162 via the suction passage 60 provided in the lower support member 56. Then, the refrigerant gas is compressed by the operations of the roller 48 and the vane not shown of the first rotary compression element 32 to be changed into intermediate pressure (about 8 MPaG). Consequently, the intermediate pressure refrigerant gas is discharged into the noise eliminating chamber 64 from the high pressure chamber side of the cylinder 40 via the discharge port not shown.

The intermediate-pressure refrigerant discharged into the noise eliminating chamber 64 is drawn into the refrigerant introduction pipe 92, passes over the suction passage 58 of the upper support member 54 via the outside of the sealed container 12, and then is drawn into the low pressure chamber side of the upper cylinder 38 from the suction port 161. At this time, the refrigerant gas is cooled when it passes through the refrigerant introduction pipe 92 provided outside the sealed container 12.

The intermediate-pressure refrigerant gas drawn into the low pressure chamber side of the upper cylinder 38 is compressed by the operations of the roller 46 and the vane not shown of the second rotary compression element 34 into high-temperature and high-pressure (about 10 to 12 MPaG)

refrigerant gas, which is then discharged from the high pressure chamber side of the cylinder 38 into the noise eliminating chamber 62 via the discharge port not shown.

The high-temperature and high-pressure refrigerant gas discharged into the noise eliminating chamber 62 is discharged from the discharge hole 120 of the upper cover 66 into an area under the drive element 14 inside the sealed container 12, and then passes through a clearance between the members to reach the upper side of the drive element 14, so that the refrigerant gas is discharged to the outside of the compressor via the sleeve 144.

When the rotary compressor 10 is incorporated as, for example, a compressor for an air conditioner, the high-temperature and high-pressure refrigerant gas fed through the refrigerant discharge pipe connected to the sleeve 144 is introduced into a heat exchanger, so that the heat is radiated and the refrigerant gas is condensed. The condensed low-temperature and high-pressure refrigerant liquid is subjected to reduced pressure using an expansion valve to flow into an evaporator, where it is evaporated, and then flows back into the compressor through the refrigerant introduction pipe 94. This cycle is repeated. The latent heat caused by evaporating the refrigerant in the evaporator produces the cooling effect.

Figure 2:
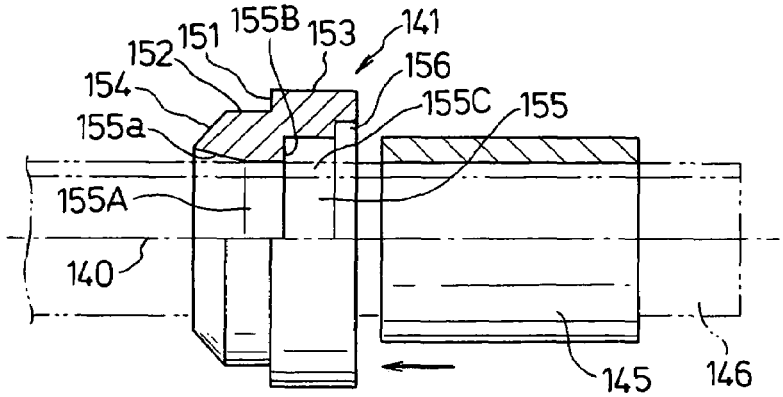
FIG. 2 is a longitudinal side view of a sleeve constituting a part of the compressor of the embodiment.
Figure 3:
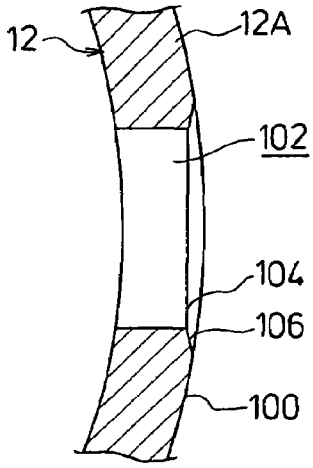
FIG. 3 is a longitudinal side view of a sealed container (through hole part) constituting a part of the compressor of the embodiment.
Figure 4:
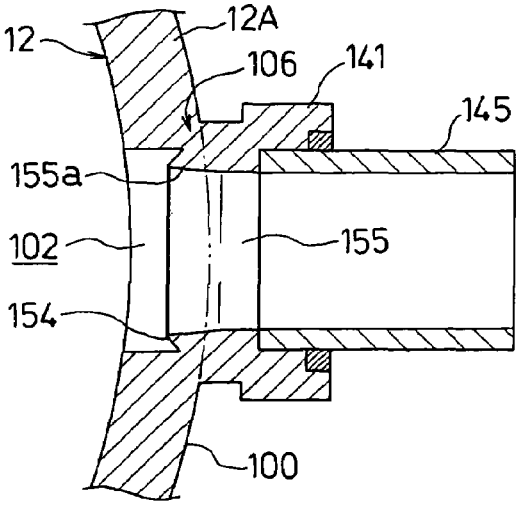
FIG. 4 is an enlarged longitudinal side view of a principal part of the compressor (through hole of the sealed container) of the embodiment.
Figure 5:
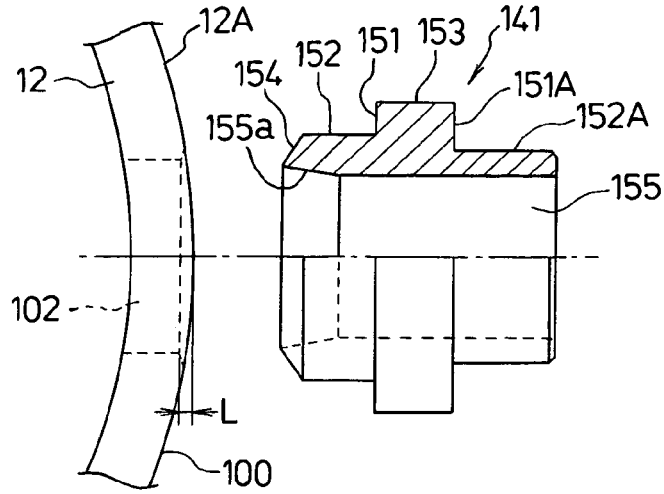
FIG. 5 is a longitudinal side view of another sleeve constituting a part of the compressor of another embodiment.

The rotary compressor 10 may include a sleeve having a shape such as that shown in FIG. 5 instead of a shape such as shown in FIG. 2, connected to the refrigerant introduction pipe 92 or the like and attached to the container body 12A.

That is, the sleeve 141 as shown in FIG. 5 may be a sleeve including the diameter-enlargement portion 155*a* without having the small-inner-diameter portion 155A and the large-inner-diameter portion 155C, and thus without having the surrounding step portion 155B, with the through hole 155 having the constant inner diameter over the entire area except for the diameter-enlargement portion 155*a*. (Note that each of the sleeves 142 to 144 has the same structure as that of the sleeve 141, and thus explanation thereof is substituted for explanation of the sleeve 141.)

In the sleeve 141, a second surrounding step portion 151A is provided on the side where the surrounding step portion 151 of the large-outer-diameter portion 153 is not provided, and a second small-outer-diameter portion 152A is extended therefrom. The second small-outer-diameter portion 152A has a diameter smaller than that of the small-outer-diameter portion 152.

Even in the rotary compressor 10 with the sleeve 141 having a shape such as that shown in FIG. 5, attached to a main part of the container body 12A by the projection welding, the difference between the outer and inner diameters of the tapered diameter-reduction portion 154 of the sleeve 141 is smaller than that of the conventional sleeve, resulting in a small length L over which the container body 12A is pushed and moved in the projection welding, thereby reducing the amount of deformation of the container body 12A.

Since the difference between the outer and inner diameters of the tapered diameter-reduction portion 154 of the sleeve 141 is set smaller, any fluctuations in stroke of pressure applied in the projection welding does not affect largely the size of the contact area with the sealed container 12. This results in small fluctuations in current density, and thus provides the stable welding.

As the diameter-enlargement portion 155*a* whose inner diameter is gradually increased towards the end of the sleeve 141 is provided in the through hole 155 of the sleeve 141, even if the inner diameter of the small-outer-diameter portion 152 on the end side is decreased by heat and pressure applied in the projection welding, it does not become smaller than the inner diameters of other parts of the through hole 155.

Although in the first embodiment as described in detail, the multistage compression type rotary compressor of the inside high-pressure type is exemplified as the compressor of the invention, the invention is not limited thereto. The compressor of the invention may be a multistage compression type rotary compressor of an inside intermediate-pressure type, which has been proposed in patent publications or the like in the prior art. Note that in the invention, a one-stage compression type rotary compressor, or a one-stage or multistage compression type rotary compressor of a scroll type or a reciprocating type may be useful as compression means incorporated in the sealed container 12.

What is claimed is:

1. A compressor comprising sleeves respectively attached to an inlet and an outlet for a refrigerant provided in and opened to a sealed container, by projection welding, in which a refrigerant is introduced from an outside of the container via a refrigerant introduction pipe connected to the container via the sleeve for the refrigerant inlet, and then the refrigerant introduced is compressed by compression means incorporated in the sealed container to be discharged to the outside of the container via a refrigerant discharge pipe connected to the container via the sleeve for the refrigerant outlet, wherein the sleeve includes a through hole penetrating a small-outer-diameter portion and a large-outer-diameter portion which are provided consecutively via a step portion, and wherein a diameter of an outer peripheral part of the sleeve on the open end side of the small-outer-diameter portion has a tapered part being gradually decreased towards the open end side and a diameter of an inner peripheral part of the sleeve on the open end side of the small-outer-diameter portion is gradually increased towards the open end side, and said sleeves are attached to the sealed container by the projection welding with the tapered part facing the outside of the sealed container and fitting into the respective inlet and outlet of the sealed container from the outside.

2. A compressor comprising sleeves respectively attached to an inlet and an outlet for a refrigerant provided in and opened to a sealed container, by projection welding, in which a refrigerant is introduced from an outside of the container via a refrigerant introduction pipe connected to the container via the sleeve for the refrigerant inlet, and then the refrigerant introduced is compressed by compression means incorporated in the sealed container to be discharged to the outside of the container via a refrigerant discharge pipe connected to the container via the sleeve for the refrigerant outlet, wherein the sleeve includes a through hole penetrating a small-outer-diameter portion and a large-outer-diameter portion which are provided consecutively via a step portion, the through hole being formed of a small-inner-diameter portion provided mainly in the small-outer-diameter portion and a large-inner-diameter portion provided in the large-outer-diameter portion, the small-inner-diameter portion and the large-inner-diameter portion being provided consecutively via another step portion, and wherein a diameter of an outer peripheral part of the sleeve on the open end side of the small-outer-diameter portion has a tapered part being gradually decreased towards the open end side and a diameter of an inner peripheral part of the sleeve on the open end side of the small-outer-diameter portion is gradually increased towards the open end side, and said sleeves are attached to the sealed container by the projection welding with the tapered part facing the outside of the sealed container, and fitting into the respective inlet and outlet of the sealed container from the outside.

3. The compressor according to claim 2, wherein the sleeve made of iron-based material is provided with a pipe member made of copper-based material which is inserted into the large-inner-diameter side of the through hole with an end thereof abutted against the step portion to be brazed and fixed to the sleeve, and said sleeve is attached to the sealed container made of iron-based material by the projection welding.

* * * * *